US007357110B2

(12) United States Patent
Hashimoto et al.

(10) Patent No.: US 7,357,110 B2
(45) Date of Patent: Apr. 15, 2008

(54) RESIN INTAKE MANIFOLD

(75) Inventors: Yasuki Hashimoto, Okazaki (JP); Fumihiro Shinkai, Chiryu (JP)

(73) Assignees: Toyota Jidosha Kabushiki Kaisha, Toyota-shi (JP); Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 11/486,125

(22) Filed: Jul. 14, 2006

(65) Prior Publication Data

US 2006/0249115 A1 Nov. 9, 2006

(30) Foreign Application Priority Data

Aug. 2, 2005 (JP) ..... 2005-223771

(51) Int. Cl.
*F02M 35/104* (2006.01)
*F02M 35/12* (2006.01)

(52) U.S. Cl. ..... 123/184.47; 123/184.53; 123/184.57; 123/184.34; 123/184.42

(58) Field of Classification Search ..... 123/184.34, 123/184.35, 184.42, 184.43, 184.47, 184.48, 123/184.51, 184.53, 184.57, 184.21
See application file for complete search history.

(56) References Cited

U.S. PATENT DOCUMENTS 4,715,348 A * 12/1987 Kobayashi et al. ..... 73/116
5,572,979 A * 11/1996 Czadzeck ..... 123/568.17
6,675,756 B2 * 1/2004 Katayama ..... 123/184.34
6,732,504 B2 * 5/2004 Majima et al. ..... 60/284

FOREIGN PATENT DOCUMENTS

| | | |
|---|---|---|
| JP | U 4-104153 | 9/1992 |
| JP | A 11-148431 | 6/1999 |
| JP | A 2000-257519 | 9/2000 |
| JP | A 2000-320413 | 11/2000 |
| JP | A 2002-235620 | 8/2002 |
| JP | A 2003-254178 | 9/2003 |
| JP | A 2004-124831 | 4/2004 |

* cited by examiner

*Primary Examiner*—Stephen K. Cronin
*Assistant Examiner*—Ka Chun Leung
(74) *Attorney, Agent, or Firm*—Kenyon & Kenyon LLP

(57) ABSTRACT

A raised portion is formed at a predetermined location on an inside surface of a wall portion of an intake manifold. A gas introduction hole for introducing gas containing water vapor is formed in another predetermined location, other than in the raised portion, in the inside surface of the wall portion. An intake air negative pressure outlet hole for releasing intake air negative pressure within the surge tank to the outside is formed in the raised portion. A guide groove which catches moisture that trickles down the inside surface of the wall portion above the raised portion and guides it to a location away from the intake air negative pressure outlet hole, is formed in a region above the intake air negative pressure outlet hole in a rising surface of the raised portion.

12 Claims, 9 Drawing Sheets

RESIN INTAKE MANIFOLD

INCORPORATION BY REFERENCE

The disclosure of Japanese Patent Application No. 2005-223771 filed on Aug. 2, 2005, including the specification, drawings and abstract is incorporated herein by reference in its entirety.

BACKGROUND OF THE INVENTION

1. Field of the Invention

The invention relates to an intake manifold used in an internal combustion engine or the like mounted in a vehicle such as an automobile, for example.

2. Description of the Related Art

The engine to be mounted is provided with an intake manifold for supplying air to a combustion chamber. The intake manifold is such that a plurality of intake passages which are connected to a plurality of intake ports of the internal combustion engine are formed integrated with a surge tank which is disposed upstream of those intake passages and to which an outside air intake path is connected.

An intake manifold is provided with a gas introduction hole and an intake air negative pressure outlet hole. The gas introduction hole is provided for introducing gas containing water vapor or oil content in the form of mist, such as EGR gas (re-circulated exhaust gas), purge air from a canister, or blow-by gas in the crankcase, or the like. The intake air negative pressure outlet hole is provided for applying intake air negative pressure within the surge tank to a brake booster or the like, for example.

The gas introduction hole and the intake air negative pressure outlet hole are preferably arranged in locations that are relatively far apart from each other so that the water vapor that is mixed in with the gas introduced from the gas introduction hole is less apt to adhere to the inside opening of the intake air negative pressure outlet hole. This arrangement may be difficult to achieve, however, depending on how the intake manifold is mounted.

Also, the water vapor mixed in with the gas that is introduced from the gas introduction hole may adhere to the inside surface of a wall portion that forms the surge tank and form water droplets. If these water droplets trickle down the inside surface of the wall portion and adhere to the inside opening of the intake air negative pressure outlet hole, they may freeze and block the opening.

Taking this into consideration, various ways to make inhibit the water droplets from adhering to the inside opening of the intake air negative pressure outlet hole have been devised. For example, the art disclosed in Japanese Patent Application Publication No. JP-A-2004-124831 provides a baffle plate around the intake air negative pressure outlet hole, while the art disclosed in Japanese Patent Application Publication No. JP-A-2003-254178 provides a partition wall portion in front of the intake air negative pressure outlet hole.

While the conventional examples described above may make it possible to prevent water droplets adhering to the inside surface of the wall portion that forms the surge tank from adhering to the inside opening of the intake air negative pressure outlet hole and freezing, the baffle plate and partition wall portion have comparatively complicated shapes, which means that a mold must be designed taking into account workability when opening the mold. As a result, designing the mold is difficult and increases manufacturing costs. Thus there remains room for improvement.

In addition, with a metal intake manifold, it is possible to insert a cylindrical pipe through the intake air negative pressure outlet hole in state in which it protrudes from the inside opening such that water droplets are inhibited from adhering to the inside protruding end of the cylindrical pipe. The problem with this arrangement, however, is that not only is it heavy, which goes against recent technological trends, but costs may increase due to the increase in the number of parts and assembly processes and the like.

Also, when an intake manifold such as that described above is manufactured out of resin in order to reduce both costs and weight, it is necessary in forming the protruding portion that corresponds to the cylindrical pipe described above to design a mold taking into account workability when opening the mold, which is extremely difficult to the point to which it may be considered impractical.

SUMMARY OF THE INVENTION

This invention thus provides an intake manifold with a surge tank used in an internal combustion engine, which has a structure which i) makes it possible to prevent a phenomenon in which water droplets that trickle down an inside surface of a wall portion that forms the surge tank freeze and block the inside opening of an intake air negative pressure outlet hole, as well as which ii) can be manufactured relatively easily.

A first aspect of the invention relates to an intake manifold in which an intake passage that is connected to an intake port of an internal combustion engine is integrally formed with a surge tank which is arranged on the upstream side of the intake passage and which is connected to an outside air intake path. This intake manifold includes i) a raised portion provided in a first predetermined location on an inside surface of a wall portion which forms the surge tank, ii) a gas introduction hole provided in a second predetermined location, other than in the raised portion, in the inside surface of the wall portion, iii) an intake air negative pressure outlet hole provided in the raised portion, and iv) a guide portion which catches moisture that trickles down the inside surface of the wall portion above the raised portion and guiding the moisture to a location away from the intake air negative pressure outlet hole, and which is provided in a region above the intake air negative pressure outlet hole in the rising surface of the raised portion.

In the foregoing intake manifold described above, the guide portion may be formed by a groove.

According to this structure, the inside surface of the wall portion in which the gas introduction hole is provided and the raised portion in which the intake air negative pressure outlet hole is provided are on different planes. As a result, even if water droplets adhering to the inside surface of the wall portion trickle down the inside surface of the wall portion, although they will run down to the rising surface of the raised portion, those water droplets are inhibited from reaching the inside opening of the intake air negative pressure outlet hole. Moreover, the water droplets that have run down to the rising surface of the raised portion are guided by the guide portion provided in the rising surface so that they run down away from the intake air negative pressure outlet hole, not toward the tip end side in the rising direction of the raised portion. Accordingly, it is possible to avoid a phenomenon in which the inside opening of the intake air negative pressure outlet hole becomes blocked by frozen moisture.

In addition, only the raised portion which is on a different plane than the rest of the inside surface of the wall portion is formed on the inside surface of the wall portion. Therefore, if the intake manifold were made by resin forming, it is possible to make the structure simple such that the mold can be opened easily and the manufacturing costs of the mold can be reduced.

The intake manifold according to the invention makes it possible to prevent a phenomenon in which moisture in the surge tank freezes and blocks the inside opening of the intake air negative pressure outlet hole. Moreover, that structure can be made relatively simply. Thus, when the intake manifold is made by resin forming, it is possible to make the structure simple such that the mold can be opened easily and the manufacturing costs of the mold can be reduced, in turn enabling the cost of the product to be reduced.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

One example embodiment of the invention will hereinafter be described with reference to FIGS. 1 to 6. In this example embodiment, the internal combustion engine with which the intake manifold is used is a 4-cylinder gasoline engine to be mounted in a vehicle, for example. However, the engine is not limited to this. For example, it may have a different number of cylinders, or may be a diesel engine.

Figure 1:
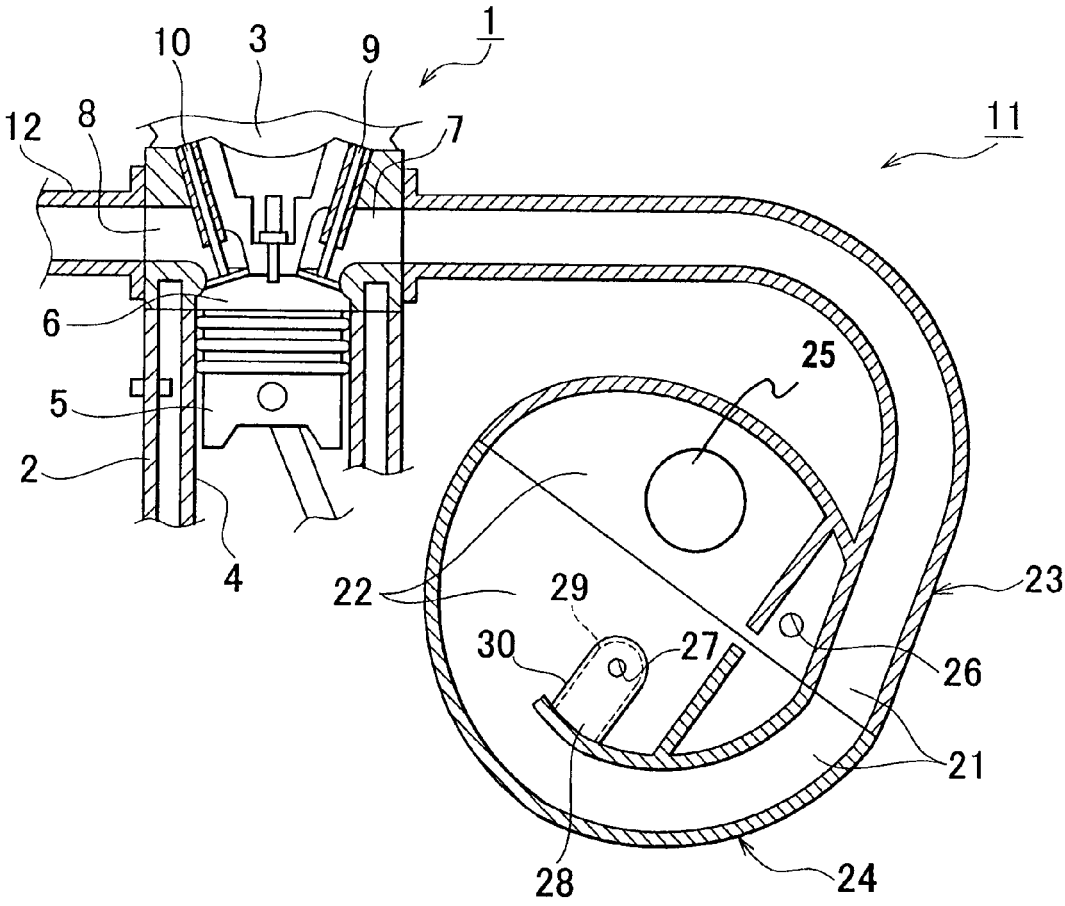
FIG. 1 is a sectional view of an arrangement of an intake manifold according to one example embodiment of the invention.

First, the arrangement of the intake manifold will briefly be described with reference to FIG. 1. In the drawing, an engine 1 is provided with a cylinder block 2 and a cylinder head 3.

The cylinder block 2 has a plurality of (in this case, four) cylinders 4, each of which has a piston 5 inserted therein which can move reciprocally. A combustion chamber 6 is formed in each cylinder 4 by the space between the upper end of the piston 5 and the cylinder head 3.

In the cylinder head 3, an intake port 7 and an exhaust port 8 are provided for each combustion chamber 6. The inside openings (on the combustion chamber 6 side) of the intake port 7 and the exhaust port 8 are opened and closed by an intake valve 9 and an exhaust valve 10, respectively.

An intake manifold 11 is attached to the intake ports 7 and an exhaust manifold 12 is attached to the exhaust ports 8. Although not shown, an air intake system which includes an intake pipe, a throttle body which opens and closes in response to an operation of an accelerator peddle, and an air cleaner and the like is attached to the intake manifold 11.

The structure of the intake manifold 11 according to one example embodiment of the invention will now be described in detail.

The intake manifold 11 is structured such that a plurality of (i.e., four in this case) intake passages 21 that are connected to the intake ports 7 of the engine 1 are integrally formed with a surge tank 22 which is arranged upstream of the intake passages 21 and which are connected to the throttle body via the intake pipe of the air intake system described above. The surge tank 22 is formed of a single cavity of a predetermined capacity.

Figure 2:
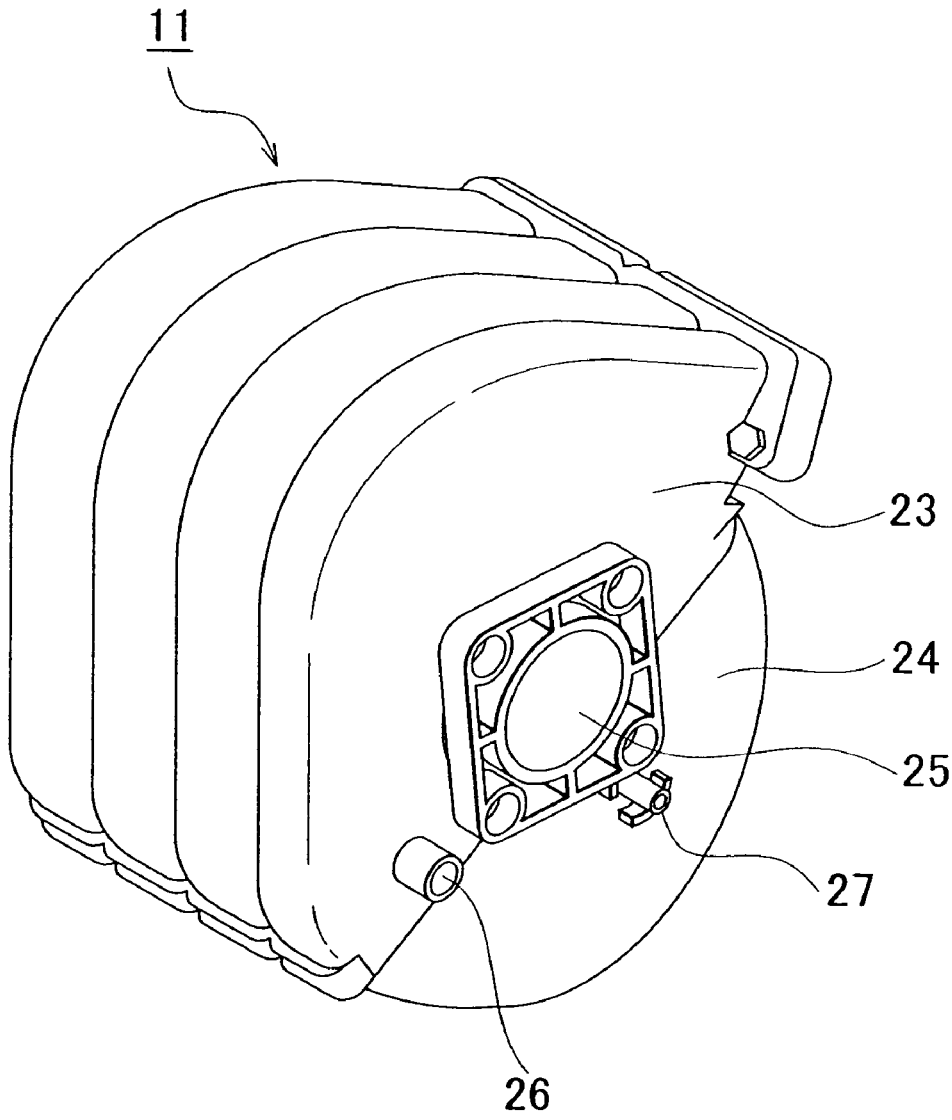
FIG. 2 is a perspective view of the outer appearance of the intake manifold shown in FIG. 1.
Figure 3:
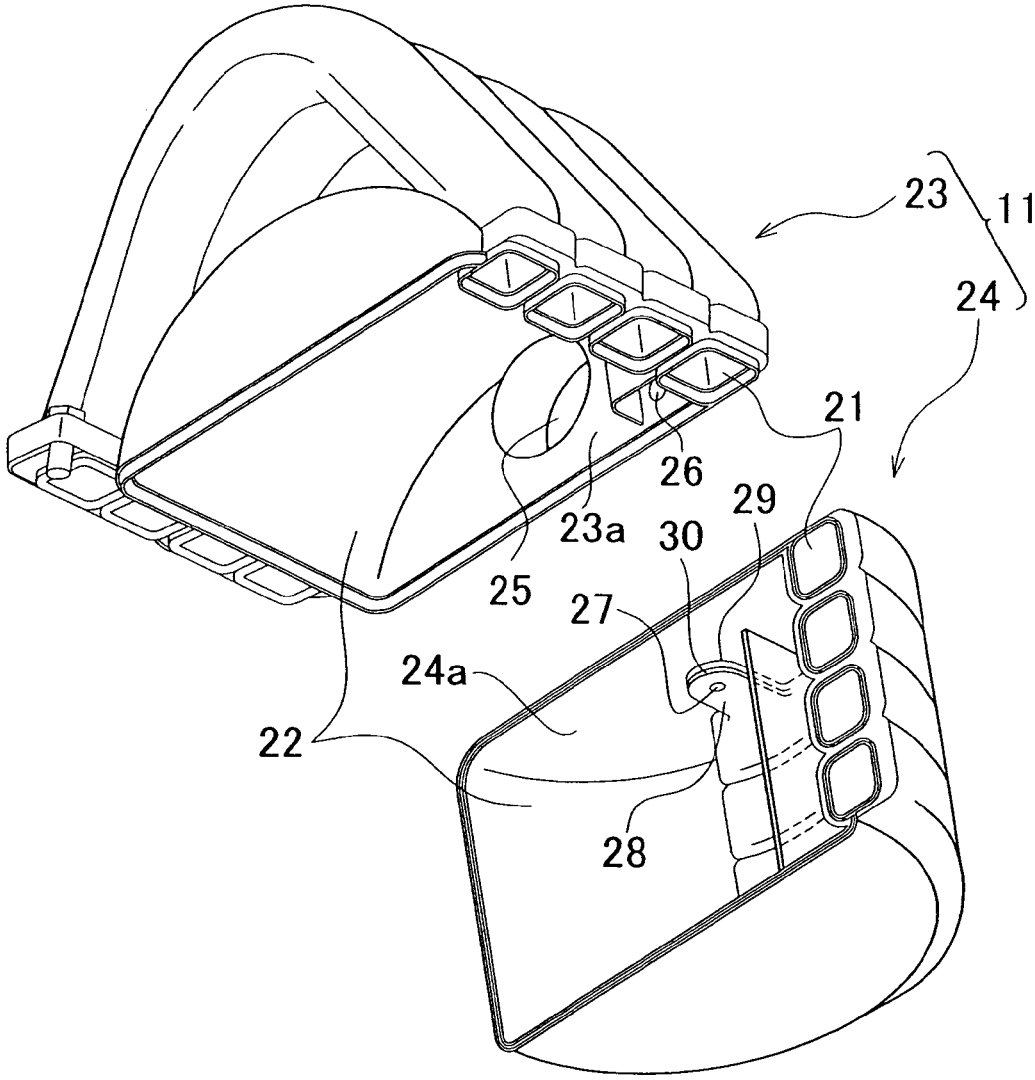
FIG. 3 is an exploded perspective view of the intake manifold in FIG. 2, as viewed from the opposite side.

In this example embodiment, the intake manifold 11 has a two-piece construction in which an upper case 23 and a lower case 24 are combined, as shown in FIG. 2 or FIG. 3. The intake passages 21 and the surge tank 22 are provided partially divided in these cases 23 and 24.

A gas introduction hole 26 and an air introduction portion 25 for introducing air from the outside into the surge tank 22 are formed in the upper case 23.

The throttle body, not shown, and the air cleaner, also not shown, are attached to the air introduction portion 25 via the intake pipe, not shown, of the air intake system described above.

Also, although not shown, various hoses such as a blow-by gas recirculation hole, a purge air hose, an exhaust gas recirculation hose, and the like, for example, are connected to the gas introduction hole 26. Gas containing water vapor or oil content in the form of mist, such as re-circulated exhaust gas, purge air from a canister, blow-by gas within the crank case, or the like, are introduced through this gas introduction hole 26 into the surge tank 22.

Further, the lower case 24 has a hollow semi-circular column shape. The upstream portions of the four intake passages 21 are integrally formed along the inner peripheral surface of the semi-circular portion of the lower case 24.

An intake air negative pressure outlet hole 27 is formed in the thickness direction through one side wall portion (one wall forming the surge tank 22) 24*a* of the two side wall portions of this lower case 24 which oppose each other substantially parallel.

Although not shown, a brake booster, for example, is connected via a brake hose, to the intake air negative pressure outlet hole 27 such that the surge tank 22 and the brake booster are connected via the intake air negative pressure outlet hole 27.

With respect to this kind of positional relationship of the gas introduction hole 26 and the intake air negative pressure outlet hole 27, one side wall portion 23*a* of the upper case 23 in which the gas introduction hole 26 is formed and the one side wall portion 24*a* of the lower case 24 in which the intake air negative pressure outlet hole 27 is formed are fitted together so as to form one continuous wall portion. Accordingly, the holes 26 and 27 are provided in a row while being relatively far apart from one another.

With this positional relationship, if the inside opening of the gas introduction hole 26 and the inside opening of the intake air negative pressure outlet hole 27 are on surfaces that are on the same plane, problems such as those described above occur. The structure of the first example embodiment of the invention will now be described in more detail.

Figure 4:
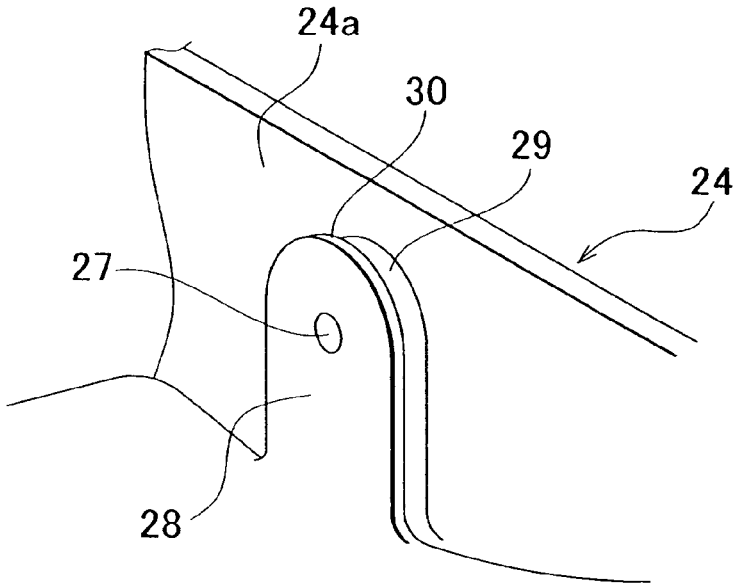
FIG. 4 is an enlarged perspective view of a main portion in the intake manifold in FIG. 1.

First, a raised portion 28 is provided in a predetermined location on the inside surface of the one side wall portion 24*a* that forms the surge tank 22 of the lower case 24. This raised portion 28 is raised and thus not on the same plane as the rest of the inside surface of the one side wall portion 24*a*. The intake air negative pressure outlet hole 27 is formed in this raised portion 28. As shown in FIG. 4, from a wall surface view, this raised portion 28 is formed in a strip with the upper end side formed in a semi-circle.

On the other hand, the gas introduction hole 26 is formed in the inside surface of the one side wall portion 23*a* that forms the surge tank 22 of the upper case 23. This one side wall portion 23*a* is on the same plane as the inside surface of the one side wall portion 24*a* of the lower case 24 described above so the gas introduction hole 26 is not on the same plane as the raised portion 28.

Therefore, the inside opening of the gas introduction hole 26 and the inside opening of the intake air negative pressure outlet hole 27 are not on the same plane.

Moreover, a guide groove 29 is formed in a region above the intake air negative pressure outlet hole 27 in the rising surface of the raised portion 28.

This guide groove 29 catches moisture that adheres to the inside surface of the one side wall portion 24*a* of the lower case 24 positioned above the raised portion 28 and trickles down the inside surface, and guides it to a location away from the intake air negative pressure outlet hole 27. In this example embodiment, the guide groove 29 is obtained by providing a dam 30 that juts upward at the tip end side in the rising direction on the rising surface of the raised portion 28.

More specifically, as shown in FIG. 4, the upper end of the raised portion 28 is semi-circular so the rising surface of the raised portion 28 is also semi-circular, and the dam 30 is provided along this rising surface. Therefore, the guide groove 29 curves in an inverted U-shape such that moisture that had trickled down to the guide groove 29 then runs down both end sides of the raised portion 28 by its own weight.

In the illustrated example, the dam 30 is provided on the tip end edge in the rising direction on the rising surface of the raised portion 28, but it may also be provided in a position farther inward toward the base side of the raised portion 28 than the tip end edge.

Next, with the engine 1 described above, when the engine 1 starts, outside air is introduced into the surge tank 22 of the intake manifold 11 from the air introduction portion 25 via the air cleaner and the intake pipe, not shown. That air is then introduced into the combustion chamber 6 from the intake port 7 of the cylinder head 3 via the intake passages 21.

In this kind of process, gas containing water vapor or oil content in the form of mist, such as EGR gas (re-circulated exhaust gas), purge air from a canister, not shown, or blow-by gas in the crankcase, also not shown, or the like is introduced from the gas introduction hole 26 into the surge tank 22. The water vapor contained in these gases may adhere to the inside surface of the upper case 23 and the lower case 24 which form the surge tank 22 and become water droplets.

In particular, the behavior of the water droplets that adhere to the inside surface of the one side wall portion 23*a* of the upper case 23 and the inside surface of the one side wall portion 24*a* of the lower case 24 will be described.

That is, when these water droplets trickle down the inside surface, they are caught by the guide groove 29 in the rising surface of the raised portion 28, and thus do not reach the inside opening of the intake air negative pressure outlet hole 27, because the raised portion 28 in which the intake air negative pressure outlet hole 27 is formed is on a different plane than the inside surface of the one side wall portion 24*a* in which the gas introduction hole 26 is provided.

Figure 5:
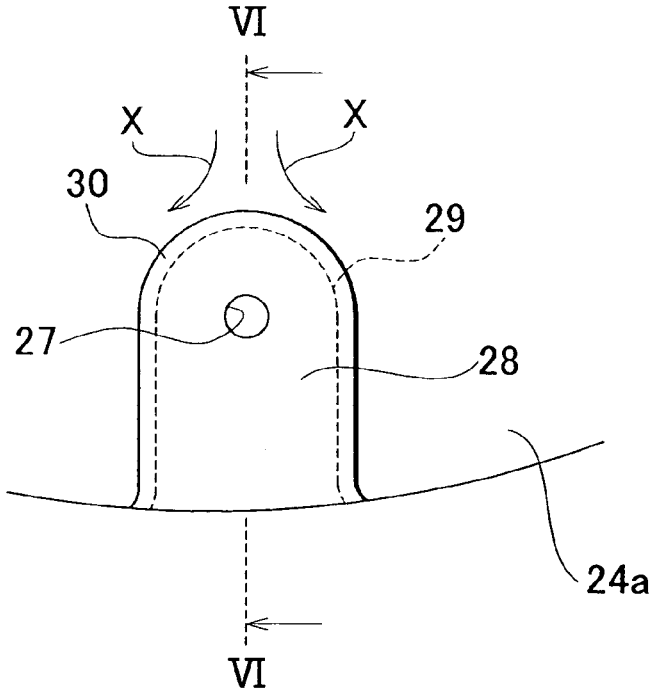
FIG. 5 is a view of a raised portion shown in FIG. 4, as viewed from the front.
Figure 6:
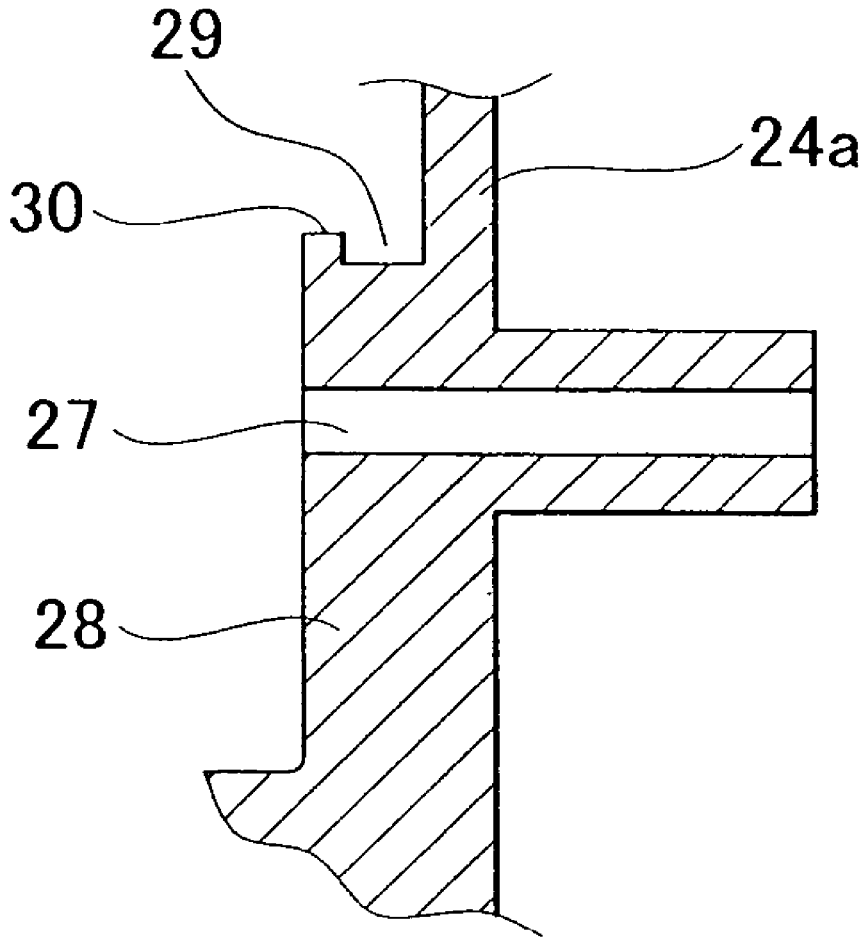
FIG. 6 is an arrow view taken along sectional line VI-VI in FIG. 5.
Figure 7:
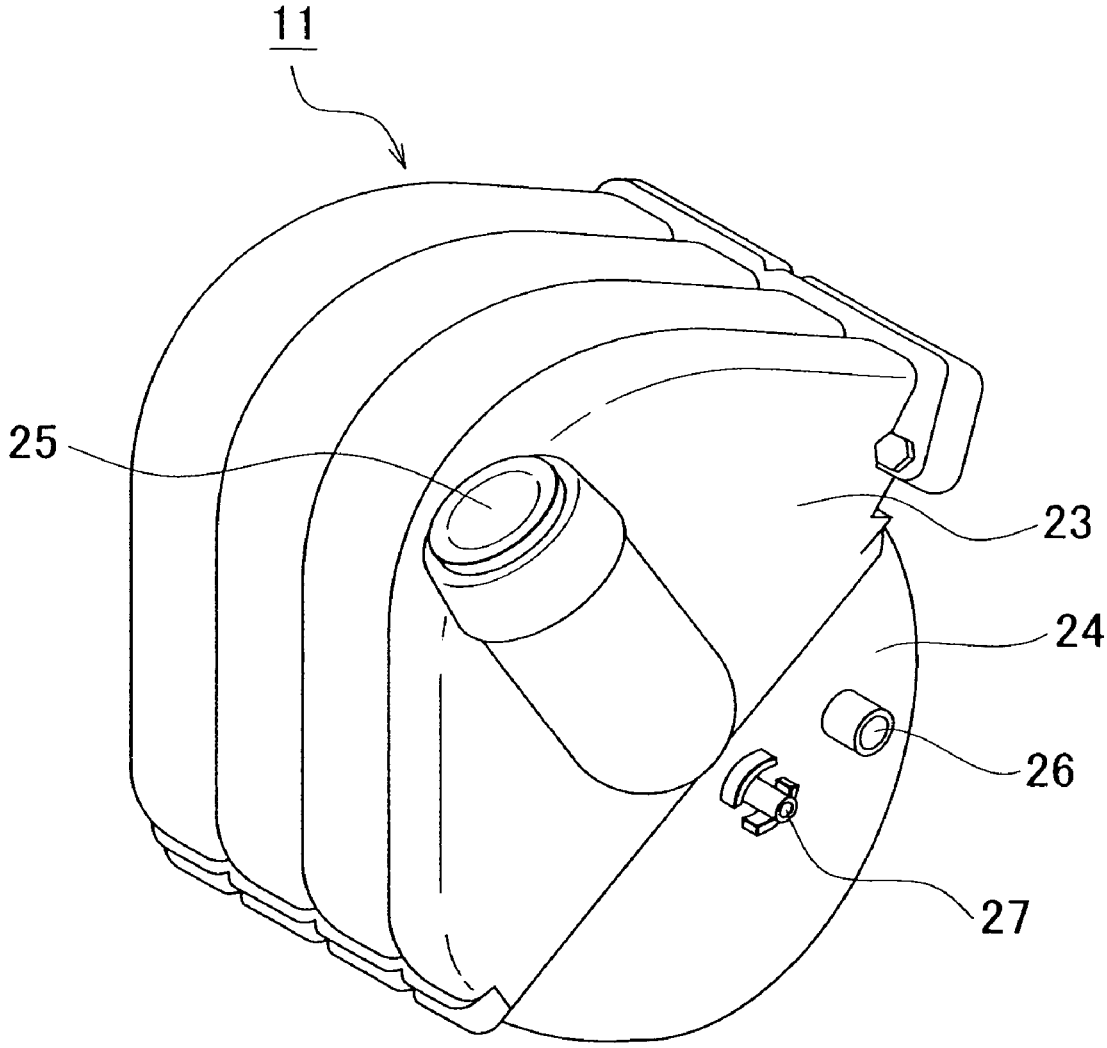
FIG. 7 is a perspective view of the outer appearance of an intake manifold according to another example embodiment of the invention.
Figure 8:
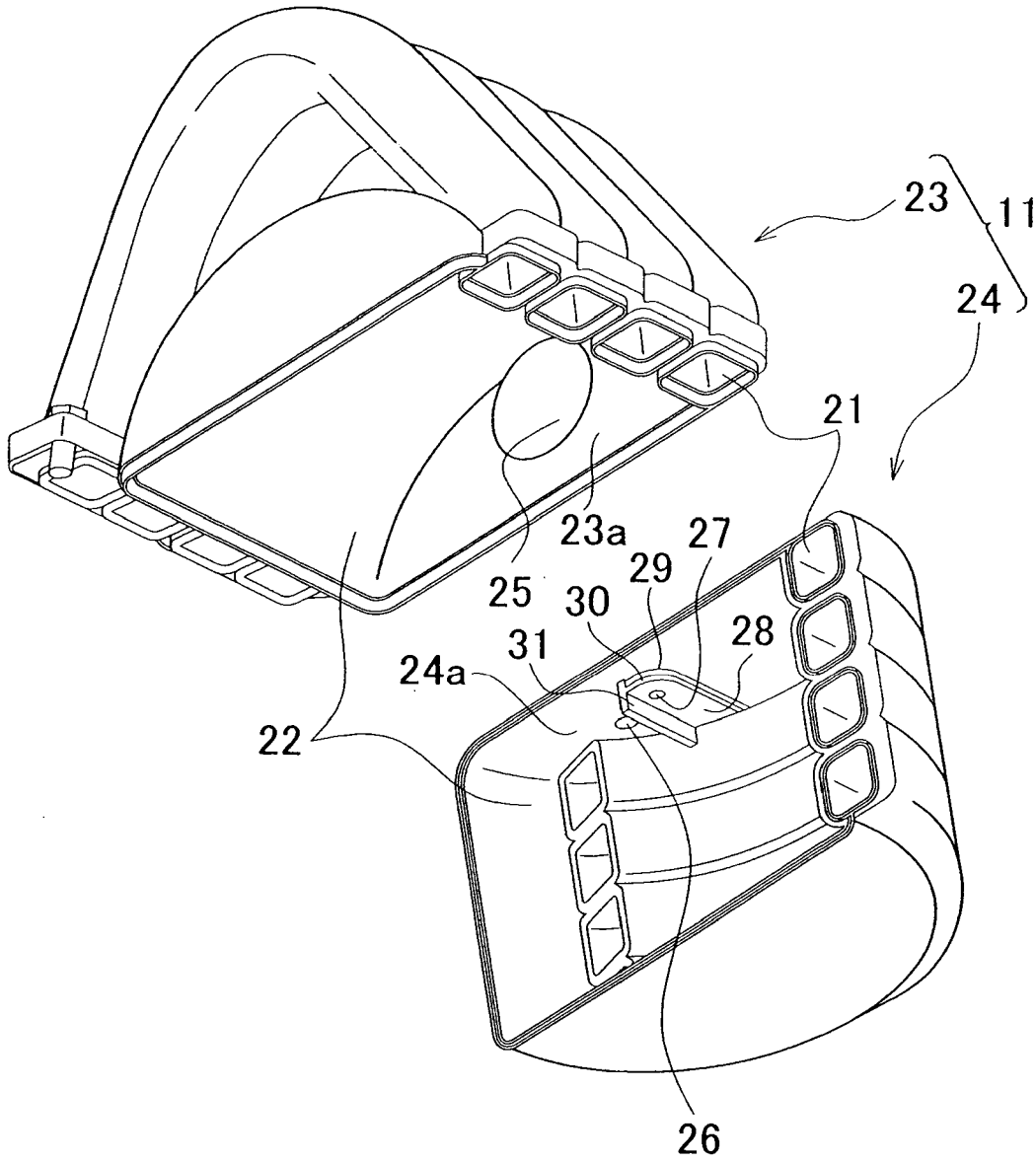
FIG. 8 is an exploded perspective view of the intake manifold in FIG. 7, as viewed from the opposite side.
Figure 9:
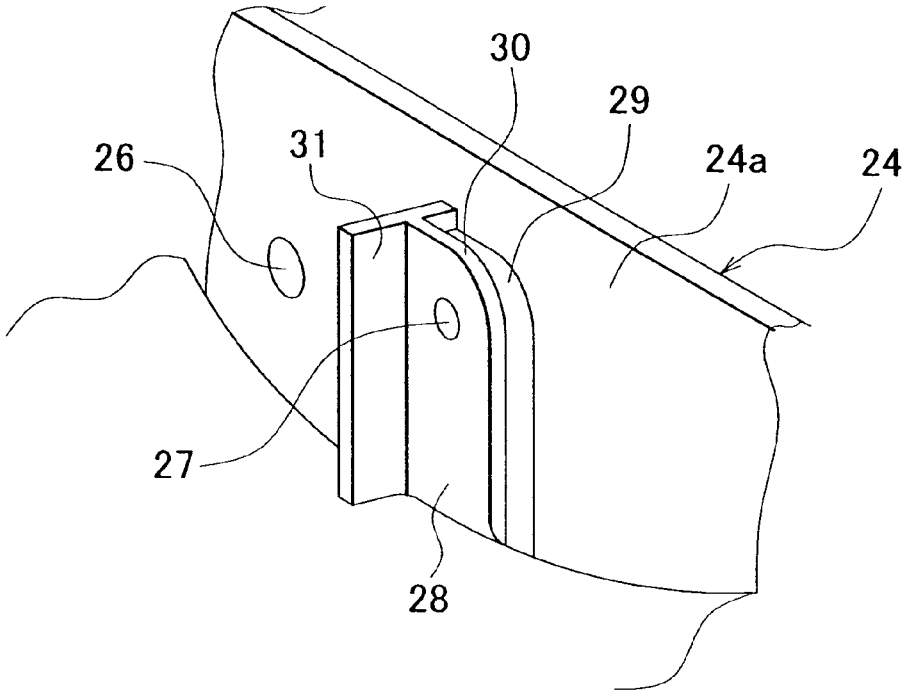
FIG. 9 is an enlarged perspective view of a main portion in the intake manifold in FIG. 7.
Figure 10:
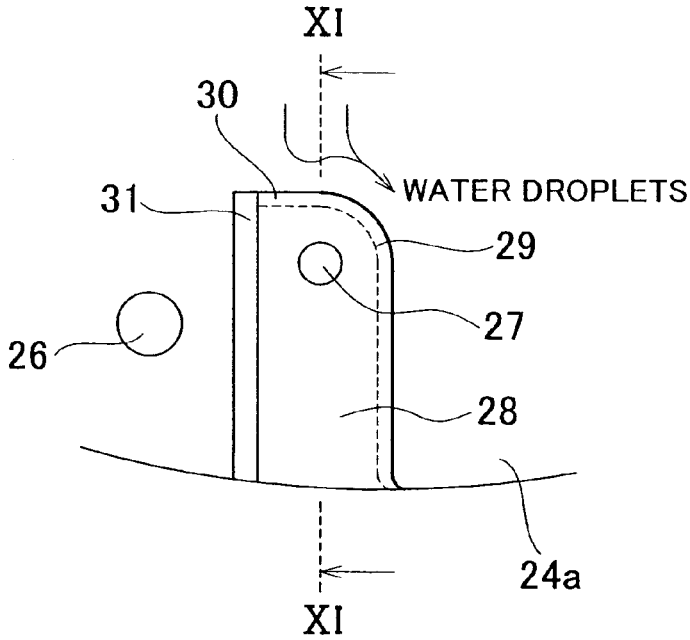
FIG. 10 is a view of a raised portion shown in FIG. 9, as viewed from the front.
Figure 11:
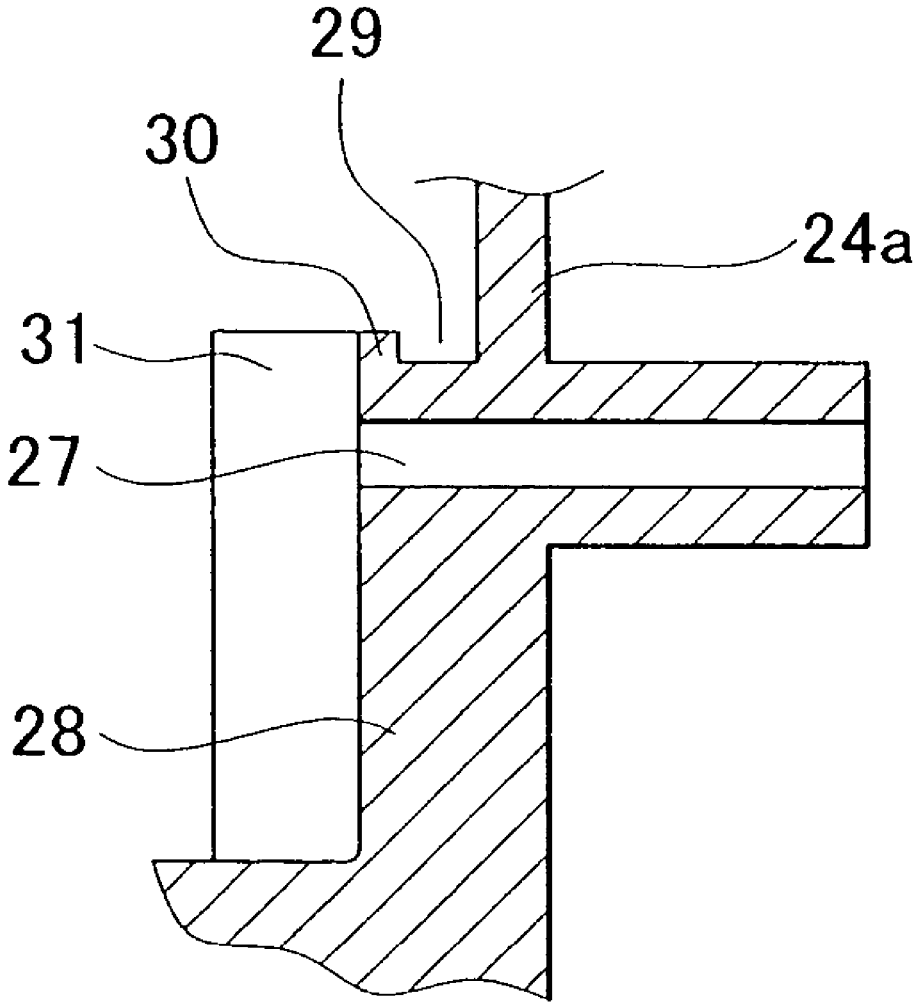
FIG. 11 is an arrow view taken along sectional line XI-XI in FIG. 10.

Moreover, water droplets that are caught by the guide groove 29 run down, by their own weight, away from the intake air negative pressure outlet hole 27, not toward the tip end side in the rising direction of the raised portion 28, as shown by the arrows X in FIG. 5.

Accordingly, this structure thus makes it possible to prevent a phenomenon in which the inside opening of the intake air negative pressure outlet hole 27 becomes blocked by frozen moisture.

As described above, even if water droplets that have adhered to the inside surface of the one side wall portion 23*a* of the upper case 23 and the inside surface of the one side wall portion 24*a* of the lower case 24 trickle down the inside surface, this example embodiment makes it possible to prevent the phenomenon in which those water droplets freeze at the inside opening of the intake air negative pressure outlet hole 27. Therefore, intake air negative pressure inside the surge tank 22 can be reliably released from the intake air negative pressure outlet hole 27, which makes it possible to ensure stable operation of a brake booster, for example.

Moreover, only the dam 30 and the raised portion 28 which is on a different plane than the inside surface of the one side wall portion 24*a* are provided. Accordingly, if the intake manifold 11 were manufactured by resin forming, it is possible to make the structure simple such that the mold can be opened easily and the manufacturing costs of the mold can be reduced.

Incidentally, although not shown, the lower case 24 is formed by a concave receiving mold and a convex press mold. The mold can be opened easily if it is designed such that a transcription pattern for obtaining the linearly shaped raised portion 28 and the dam 30 which is provided inside these molds is parallel with the direction of mold release.

Hereinafter, another example embodiment of the invention will be described.

(1) The number of intake passages 21 of the intake manifold 11 need only be the same as the number of cylinders of the engine 1, and may be set appropriately for the number of cylinders of the engine 1 in which the intake manifold 11 is to be used.

(2) The other example embodiment of the invention is shown in FIGS. 7 to 11. With the intake manifold 11 in this example embodiment, the gas introduction hole 26 and the intake air negative pressure outlet hole 27 formed in the direction of thickness are provided adjacent one another separated by a predetermined distance in the one side wall portion (one wall that forms the surge tank 22) 24*a* of the two side wall portions of the lower case 24 which oppose one another substantially parallel. A partition wall 31 which separates the intake air negative pressure outlet hole 27 and the gas introduction hole 26 is formed between those holes 26 and 27.

In this example embodiment, the other structure is similar to that of the foregoing example embodiment so descriptions thereof will be omitted.

In this way, even if the gas introduction hole 26 and the intake air negative pressure outlet hole 27 are provided next to one another in close proximity, moisture contained in the gas that is introduced from the gas introduction hole 26 can be prevented from adhering directly to the intake air negative pressure outlet hole 27. Moreover, the partition wall 31 simply juts out straight so when the intake manifold 11 is manufactured by a resin forming, it is possible to make the structure simple such that the mold can be opened easily and the manufacturing costs of the mold can be reduced, in turn enabling the cost of the product to be reduced.

While the invention has been described with reference to example embodiments thereof, it is to be understood that the invention is not limited to the example embodiments or constructions. To the contrary, modifications in design may be made as appropriate within the spirit and scope of the invention.

What is claimed is:

1. An intake manifold comprising:

an intake passage which is connected to an intake port of an internal combustion engine;

a surge tank which is arranged on an upstream side of the intake passage and which is connected to an outside air intake path;

a raised portion provided in a first predetermined location on an inside surface of a wall portion which forms the surge tank;

a gas introduction hole provided in a second predetermined location, other than in the raised portion, in the inside surface of the wall portion;

an intake air negative pressure outlet hole provided in the raised portion; and a guide portion which catches moisture that trickles down the inside surface of the wall portion above the raised portion and guiding the moisture to a location away from the intake air negative pressure outlet hole, and which is provided in a region above the intake air negative pressure outlet hole in the rising surface of the raised portion, wherein the guide portion is formed by a groove.

2. The intake manifold according to claim 1, wherein the guide portion is further formed by a dam which juts upward from the rising surface of the raised portion.

3. The intake manifold according to claim 2, wherein the dam is formed on a tip end side in the rising direction on the rising surface of the raised portion.

4. The intake manifold according to claim 1, wherein:

the intake manifold is formed of an upper case and a lower case;

an upper portion of the intake passage and an upper portion of the surge tank are provided in the upper case;

a lower portion of the intake passage and a lower portion of the surge tank are provided in the lower case; and the gas introduction hole and the intake air negative pressure outlet hole are formed in one wall portion that forms the surge tank on the lower case side.

5. The intake manifold according to claim 4, further comprising:

a partition wall that provided between the intake air negative pressure outlet hole and the gas introduction hole and separates those holes.

6. The intake manifold according to claim 1, wherein an upper end of the raised portion is semi-circular.

7. The intake manifold according to claim 1, wherein the intake manifold is made of resin.

8. The intake manifold according to claim 1, wherein a top surface of the raised portion is on a different plane than the inside surface of the wall portion that forms the surge tank.

9. The intake manifold according to claim 1, wherein the gas introduction hole is a hole which introduces, into the surge tank, at least one of blow-by gas, purge air, and re-circulated exhaust gas that includes at least water vapor.

10. The intake manifold according to claim 1, wherein the intake air negative pressure outlet hole is a hole formed through the top surface of the raised portion, in the direction of thickness of the raised portion.

11. The intake manifold according to claim 1, wherein the intake air negative pressure outlet hole is a hole which releases intake air negative pressure from within the surge tank to outside of the surge tank.

12. An intake manifold comprising:

an intake passage which is connected to an intake port of an internal combustion engine;

a surge tank which is arranged on an upstream side of the intake passage and which is connected to an outside air intake path;

a raised portion provided in a first predetermined location on an inside surface of a wall portion which forms the surge tank;

a gas introduction hole provided in a second predetermined location, other than in the raised portion, in the inside surface of the wall portion;

an intake air negative pressure outlet hole provided in the raised portion; and a guiding means for catching moisture that trickles down the inside surface of the wall portion above the raised portion and guiding that moisture to a location away from the intake air negative pressure outlet hole, provided in a region above the intake air negative pressure outlet hole in the rising surface of the raised portion, wherein the guiding means is formed by a groove.

* * * * *

UNITED STATES PATENT AND TRADEMARK OFFICE

CERTIFICATE OF CORRECTION

PATENT NO. : 7,357,110 B2
APPLICATION NO. : 11/486125
DATED : April 15, 2008
INVENTOR(S) : Yasuki Hashimoto et al.

It is certified that error appears in the above-identified patent and that said Letters Patent is hereby corrected as shown below:

| Column | Line | |
|---|---|---|
| 8 | 6 | After "wall" delete "that". |

Signed and Sealed this

Thirteenth Day of July, 2010

David J. Kappos

David J. Kappos
*Director of the United States Patent and Trademark Office*